United States Patent [19]

Baker

[11] 4,127,100

[45] Nov. 28, 1978

[54] WOOD BURNING STOVE

[76] Inventor: Arthur L. Baker, R.D. #1, Lewisberry, Pa. 17339

[21] Appl. No.: 855,932

[22] Filed: Nov. 30, 1977

[51] Int. Cl.[2] ..... F24H 3/08

[52] U.S. Cl. ..... 126/110 B; 126/61; 126/66; 126/72

[58] Field of Search ..... 126/61, 63, 66, 67, 126/70, 72, 110 B; 237/52

[56] References Cited

U.S. PATENT DOCUMENTS

| | | | |
|---|---|---|---|
| 437,692 | 10/1890 | Higgins | 126/67 |
| 585,027 | 6/1897 | Gurney | 126/72 |
| 2,316,392 | 4/1943 | Bloemsma | 126/70 |
| 3,952,721 | 4/1976 | Patterson | 126/63 |

FOREIGN PATENT DOCUMENTS

| | | | |
|---|---|---|---|
| 38,056 | 12/1886 | Fed. Rep. of Germany | 126/67 |
| 233,514 | 11/1944 | Fed. Rep. of Germany | 126/72 |
| 66,022 | 3/1943 | Norway | 126/72 |

*Primary Examiner*—William E. Wayner

*Assistant Examiner*—William E. Tapolcai, Jr.

*Attorney, Agent, or Firm*—Charles J. Long

[57] ABSTRACT

A wood burning stove for providing heated air to a room or similar area includes a fire chamber, a hearth in the forward portion of the fire chamber, draft inlet means at the front of the fire chamber and a flue at the rear of the fire chamber. Between the hearth and the flue is an enclosed air chamber having front and rear walls; the air chamber communicates at its bottom with the ambient air and at its top with one or more air pipes which extend to the front of the stove and there open to the ambient air. A baffle plate is positioned between and spaced from the air chamber and the flue. Ambient air is heated by passing it through the air chamber and air pipes after they have been heated by hot gases rising from a fire burning on the hearth; the hot gases contact the air pipes and the front wall of the air chamber and, because their normal path of travel to the flue is altered by the baffle plate, contact the rear wall of the air chamber as well.

7 Claims, 7 Drawing Figures

WOOD BURNING STOVE

BACKGROUND OF THE INVENTION

1. Field of the Invention

This invention relates to wood burning stoves in which heat from burning wood or similar fuel is used to heat the air in a room or the like. More particularly, the invention relates to such stoves in which hot gases from a fire heat the walls of passageways through which ambient air passes, the ambient air thereby being heated, and in which the flow path of the hot gases increases their contact with the passageway walls to increase the amount of heat transferred to the ambient air.

2. Description of the Prior Art

Wood burning stoves, so named because wood is the principal fuel used with them, have existed for many years. Most such stoves are of generally rectangular box-like shape and are fabricated from iron or steel plate. Common to virtually all wood burning stoves are a fire chamber or fire box in which the wood is placed for burning; draft inlet means to admit air to the fire chamber for combustion of the wood; and a flue or smokestack to allow hot gases and fumes from the fire to escape from the fire chamber. In some stoves the fire chamber includes a hearth area lined with firebrick to support the burning wood; the wood is sometimes placed directly on the brick and sometimes placed on a grate spaced above the brick. Additionally, some such stoves include controls on the draft inlet means which allow the amount of air entering the fire chamber to be decreased to a level which will just support combustion, thereby providing longer burning times for each load of wood burned.

Prior wood burning stoves have been designed in a variety of ways; most early designs of such stoves function as both cooking and heating stoves — that is, they include flat top surfaces for cooking and/or ovens for baking, and when in use also provide heat by radiation from the hot metal surfaces to the air of the rooms where they are located.

To augment the radiant heat from wood burning stoves, prior workers have devised several methods for providing a flow of heated air from the stoves. In one approach, one or more outer walls are spaced from the fire chamber walls to form an air passageway separate from the fire chamber, the passageway having a lower inlet and an upper outlet for ambient room air. Air in the passageway is heated by contact with the hot fire chamber walls and rises through the outlet, thereby drawing additional air into the passageway. As the additional air is heated, it, too rises; a low volume flow of heated air is thus established to help warm the room. This approach, while useful, is inefficient; i.e., more of the heat from the burning wood escapes through the flue than is extracted to use for heating the room.

Another more recent approach to providing a flow of heated air to a room from a wood burning stove employs what is commonly known as a step stove, in which the stove top is divided into two portions, the rear portion being at a higher level than the front portion, with a short, nearly vertical section of plate joining the two. In this approach, air from the room flows, either by convection or through use of a blower, into a pipe mounted flush with the surface of the hearth floor and extending across the hearth at the front of the fire chamber. Two other pipes, one at each side of the hearth, communicate with the first pipe. Each of the other pipes extends from the front to the rear of the fire chamber, being positioned flush with the surface of the hearth floor; at the rear of the fire chamber each pipe makes a right angle turn and extends vertically upward to a point near the top of the fire chamber, where it makes another right angle turn and extends horizontally toward the front of the fire chamber, finally opening to the room at the short section joining the front and rear portions of the stove top. This stove has improved heating efficiency because the air pipes are within the fire chamber itself and thus extract more heat from the hot gases rising from the fire than is extracted by the previously described passageway arrangement. Even here, however, a substantial amount of the heat from the burning wood passes to the flue; that this is so is evidenced by the fact that the stove described can also heat water circulating through an optional coil which encircles the flue at the rear of the fire chamber.

From the foregoing, it is evident that wood burning stoves of the prior art, while useful to some extent in heating ambient room air, do not efficiently utilize the heat from the burning wood for that purpose. Consequently, more wood is required to heat a given room with prior art stoves than would be necessary with better efficiency.

SUMMARY OF THE INVENTION

I have found that by positioning an air chamber and air pipes within the fire chamber of a wood burning stove, passing ambient air through such chamber and pipes, and suitably baffling the flow of hot gases from the fire in the stove so that such gases contact substantially all of the surfaces of the chamber and pipes, high efficiency heating of ambient air can be achieved in a wood burning stove. Because of such efficiency, less wood is required to heat a room and savings in fuel costs can thereby be realized.

According to the invention, I provide a wood burning stove for providing heated air to a room or similar area, comprising an enclosed fire chamber including a generally horizontal floor at the bottom thereof, a forward portion of the floor comprising a hearth for receiving wood to be burned; draft inlet means at the front of the fire chamber; a flue at the rear of the fire chamber and near the top thereof; an enclosed air chamber positioned between the rear of the hearth and the rear wall of the fire chamber and extending generally vertically from the bottom of the fire chamber to a point spaced from the top of the fire chamber, the air chamber having front and rear walls, a bottom and a top, the bottom of the air chamber communicating with the ambient air; at least one air pipe extending generally horizontally within and along the top portion of the fire chamber, one end of the air pipe communicating with the interior of the air chamber at the top of the air chamber and the other end opening to the ambient air at the front of the stove; and a generally vertical baffle plate positioned between and spaced from the air chamber and the rear wall of the fire chamber and extending the full width of the interior of the fire chamber, the baffle plate being joined at its top edge to the top of the fire chamber, the bottom edge of the baffle plate being spaced from the bottom of the fire chamber, whereby the flow of hot gases rising from a fire in the fire chamber will be such that the gases contact the surface of the air pipe and both the front and rear walls of the air chamber.

Preferably, the bottom of the air chamber communicates with the ambient air through a blower, whereby air can be blown through the air chamber and air pipe.

In a preferred embodiment, a plurality of air pipes is provided; one end of each air pipe communicates with the air chamber and the other end of each opens to the ambient air at the front of the stove. In a further preferred embodiment the air chamber includes interior deflecting means so constructed and arranged as to cause air blown into the chamber by the blower to flow to substantially all portions of the interior of the air chamber and to enter each of the pipes at substantially the same flow rate.

For maximizing the burn time of a load of fuel, the draft inlet means may comprise adjustable openings in the front of the fire chamber, whereby the air supplied to the fire chamber can be regulated between zero and a predetermined maximum rate.

I may include in my wood burning stove a substantially "V"-shaped trough positioned within the fire chamber, the bottom of the trough resting on the hearth and the sides of the trough sloping upwardly away from each other, whereby when several logs are stacked in the trough, complete combustion of the log at the bottom of the trough will allow another log to slide to the bottom from one of the sides, such that combustion will not be interrupted.

For use in burning coal in place of wood when desired, my stove may include grate means mounted within the fire chamber and spaced above the hearth.

Other details, objects and advantages of the invention will become apparent as the following description of a present preferred embodiment thereof proceeds.

BRIEF DESCRIPTION OF THE DRAWINGS

In the accompanying drawings I have shown a present preferred embodiment of the invention in which:

FIG. 6 is a view taken substantially along the lines 6—6 of FIG. 2 but showing an optional grate means to permit burning of coal, charcoal or the like.

DESCRIPTION OF THE PREFERRED EMBODIMENTS

I prefer the stove of my invention to be a step-stove, as described hereinabove, although the concepts involved are equally applicable to stoves of other general design., e.g., flat top stoves.

Figure 1:
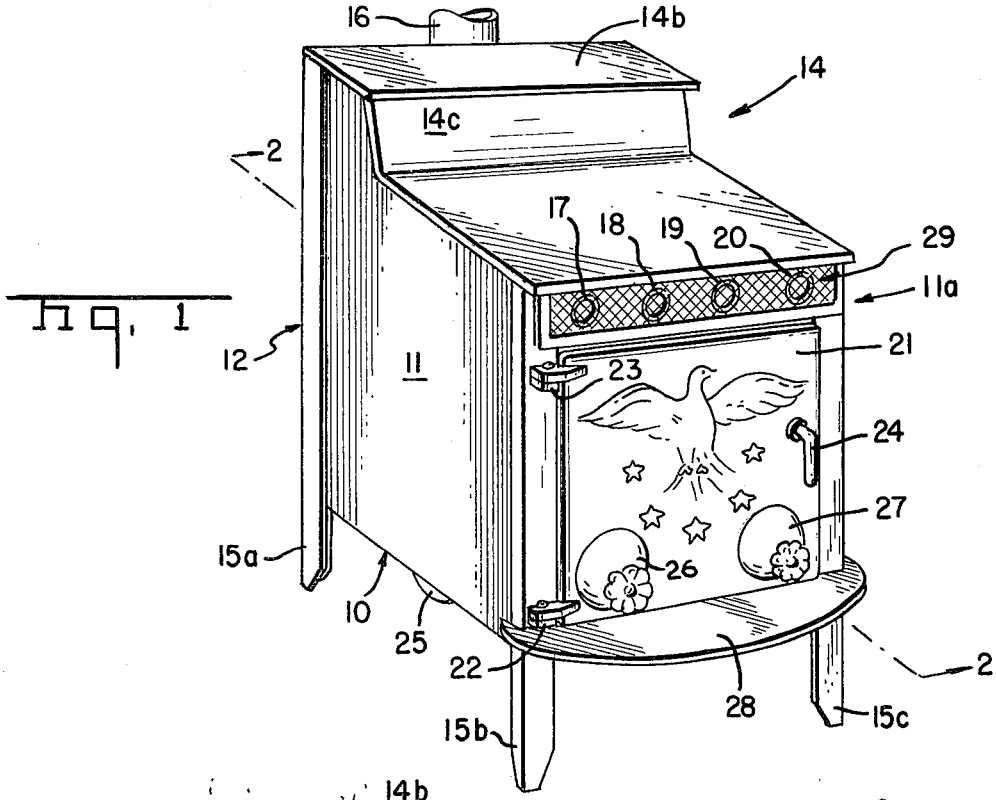
FIG. 1 is a perspective view of a stove embodying the principles of my invention.
Figure 2:
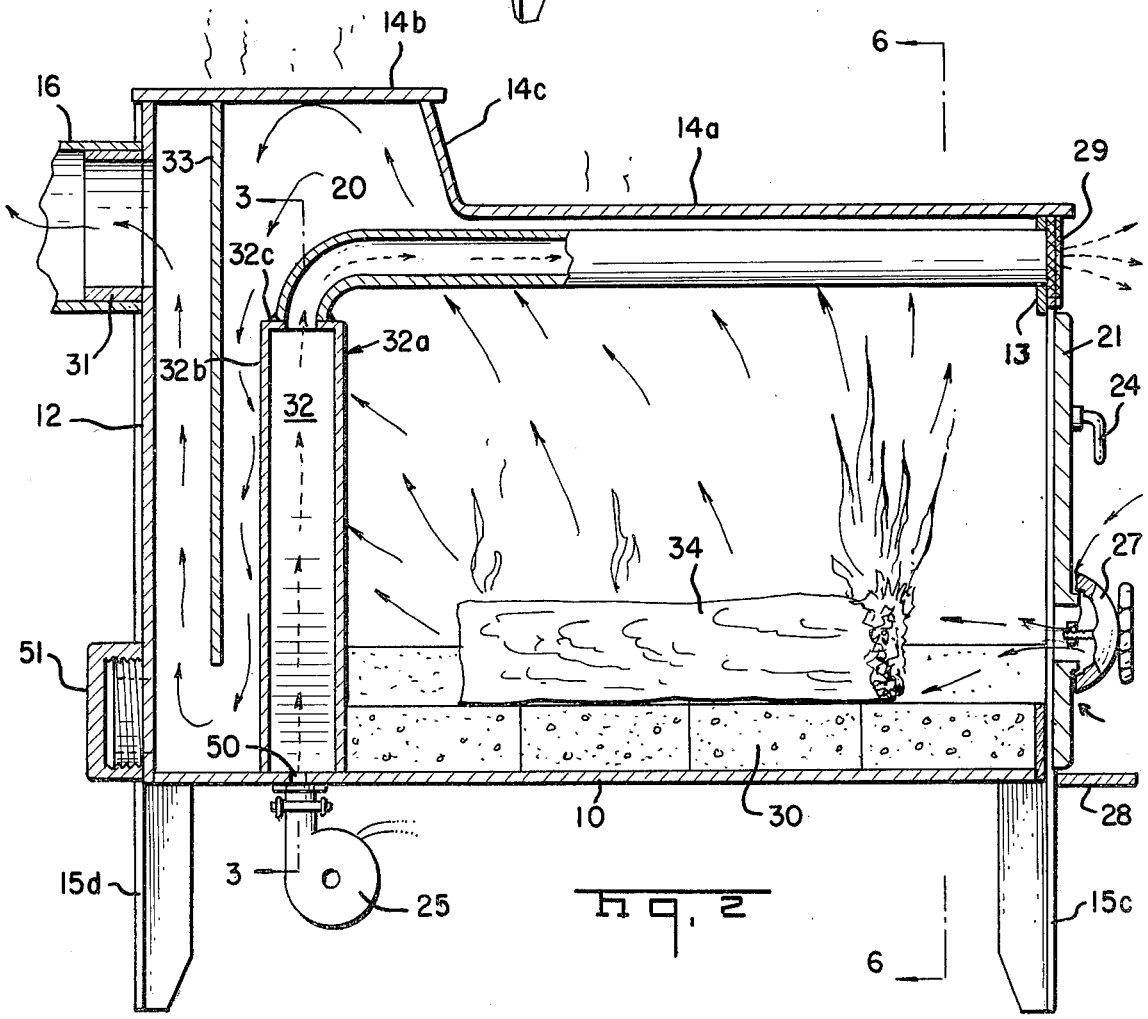
FIG. 2 is a cross-sectional view taken along the lines 2—2 of FIG. 1, illustrating the basic operation of the stove of my invention, including paths of movement of the ambient air and the gases generated by a fire within the fire chamber.

Accordingly, referring to FIGS. 1 and 2, there is shown in perspective and cross-section a step-stove of my invention. The stove includes a generally rectangular bottom plate 10 to which are joined side plates 11 and 11*a*, back plate 12, and front plate 13. I may use for these parts one-quarter inch thick steel plate, although other suitable materials can be used by those skilled in the art. The front, back and side plates support and are joined to the stove top, designated generally as 14. The top, which may be fabricated from 5/16 inch thick steel plate for example, consists of a large forward section 14*a*, a smaller rear section 14*b* at a higher level than the forward section, and a short, nearly vertical section 14*c* joining the two. The complete assembly of plates defines a fire chamber, with bottom plate 10 forming a generally horizontal floor of the chamber. In order to prevent leakage of air or gas to or from the fire chamber, I prefer to join all plates by welding.

Four angle iron legs 15*a*, 15*b*, 15*c* and 15*d*, one at each corner of the stove, support the stove above the ground or floor at a sufficient height to accommodate blower 25, partially visible in FIG. 1, which is mounted on the bottom plate 10. A flue pipe 16 allows for the escape of smoke and gases from a fire burning in the stove. Holes cut into the front plate 13 accommodate air pipes 17, 18, 19 and 20, described more fully hereinbelow, and a door 21. The door 21 is suspended from hinges 22 and 23 which are attached to leg 15*b*; a latch 24 allows the door to be opened for loading the fire chamber with wood, starting the fire, and the like; when a fire is burning in the fire chamber, the latch holds the door tightly closed so as to minimize undesired incursion of air to the fire chamber. Adjustable draft inlet means 26 and 27, described more fully hereinbelow, are provided in the door 21. Just below the door at the front of the stove is an ash catcher 28, the function of which is to prevent hot ashes or sparks from the fire from landing on the floor when the door is opened. Finally in FIG. 1, a decorative grill 29 is mounted on the front plate 13 so as to overlay the ends of the air pipes.

Figure 3:
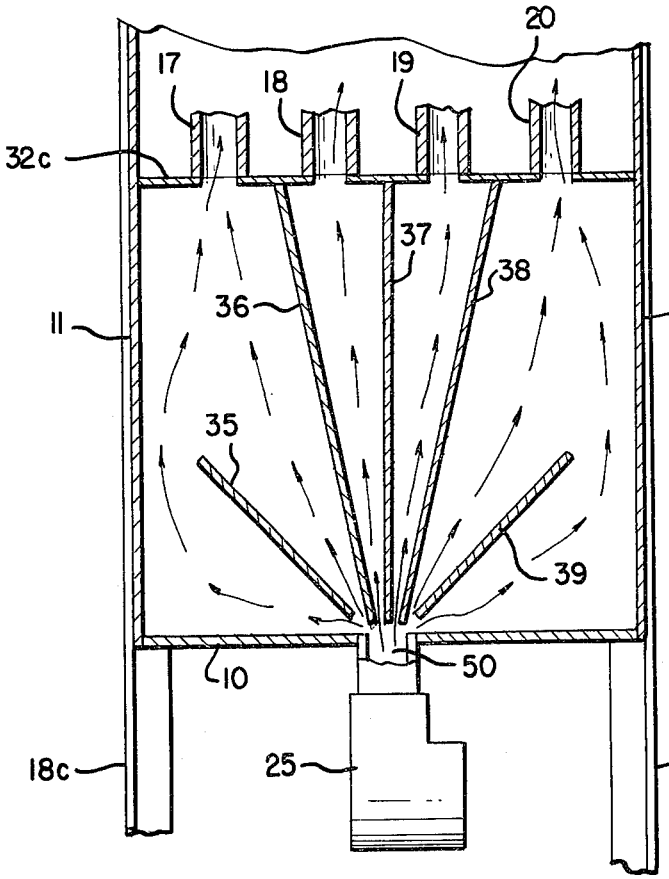
FIG. 3 is a view taken along the lines 3—3 of FIG. 2 showing the internal structure of the air chamber, including the interior deflecting means.
Figure 4:
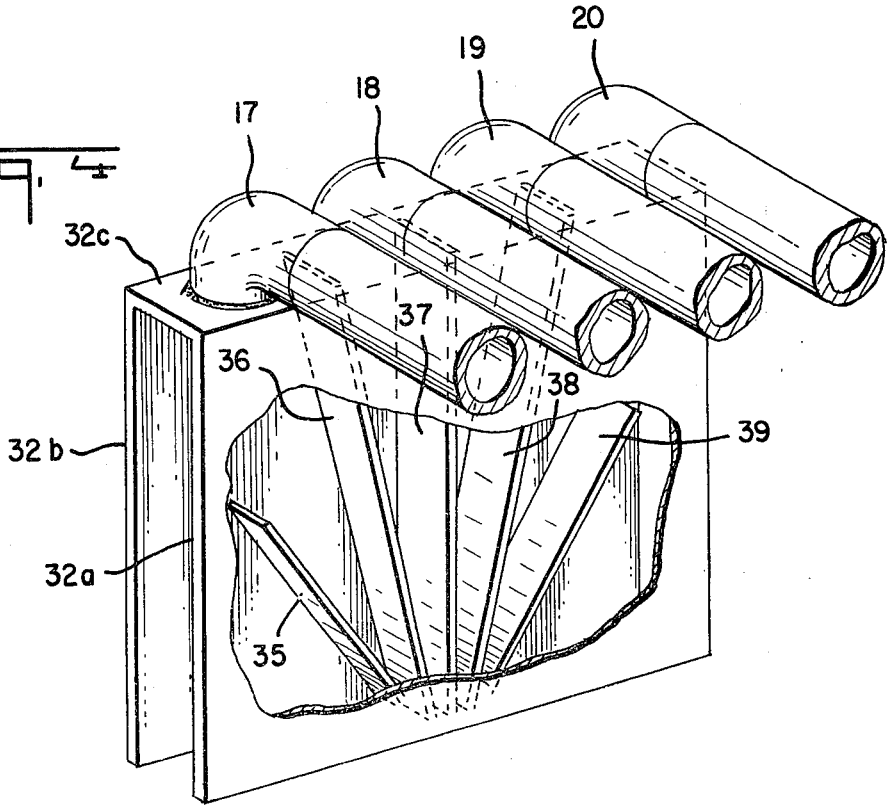
FIG. 4 is a three-dimensional view, with parts broken away, of a portion of the air chamber and interior deflecting means shown in FIG. 3 and the air pipes.
Figure 5:
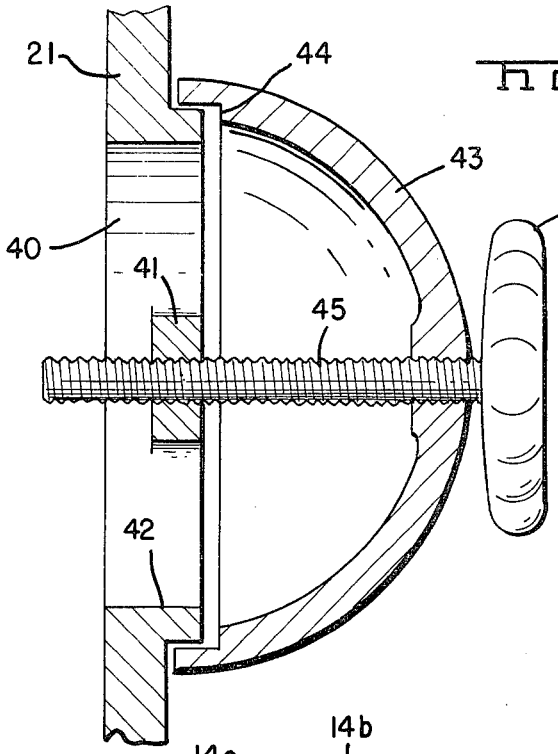
FIG. 5 is an enlarged cross-sectional view of a draft inlet control.

Turning now to FIGS. 2, 3 and 4, the forward portion of the floor 10 of the fire chamber comprises a hearth for receiving wood or other fuel to be burned; in this embodiment, the hearth is lined with fire brick 30 to minimize the effects of heat on the bottom plate 10, but fire brick is not required in the practice of the invention. At the rear of the fire chamber and near the top thereof is a flue 31 through which smoke and gases from fire in the fire chamber can escape; the flue 31 is connected to the flue pipe 16 which conducts such smoke and gases to the outside of the room in which the stove is located.

Positioned between the rear of the hearth and the rear wall 12 of the fire chamber is an enclosed air chamber 32 having front and rear walls 32*a* and 32*b*, respectively. The air chamber extends generally vertically from the bottom wall of the fire chamber to a point spaced from the top of the fire chamber. As is evident from FIG. 2 and 3, the air chamber uses as its bottom a portion of the bottom wall of the fire chamber and as its sides portions of the side walls of the fire chamber, to all of which front and rear walls 32*a* and 32*b* are welded to prevent the entry of gases or smoke from the fire into the air chamber. The top 32*c* of the air chamber is also welded in place for the same reason. As is more clearly shown in FIG. 4, air pipes 17, 18, 19 and 20 communicate at one end with the interior of the air chamber at the top thereof 32*c* and extend therefrom generally horizontally within and along the top portion of the fire chamber to the front of the stove, where they open to the ambient air. The bottom of the air chamber communicates with the ambient air through a hole 50 in bottom plate 10 and through an electric blower 25 which is attached to bottom plate 10 with its outlet tube aligned with hole 50 so as to blow air through the air chamber and air pipes at a predetermined rate.

Baffle plate 33 is positioned between air chamber 32 and the rear wall 12 of the fire chamber. The baffle plate is generally vertical and extends the full width of the interior of the fire chamber, being joined by welds (not shown) to side walls 11 and 11*a* of the fire chamber. The top edge of baffle plate 33 is welded to the top 14*b* of the fire chamber, and its bottom edge is spaced from the bottom of the fire chamber to allow for the passage under the baffle plate of smoke and gases from the fire.

At the bottom of the rear wall 12 of the fire chamber is a clean-out plug 51, which allows for the removal of any ashes that may accumulate behind air chamber 32; in operation of my stove, very few ashes accumulate behind the air chamber, so the clean-out plug is seldom used.

In use, my stove functions in the following way, viewing FIG. 2: A log 34 is placed on the hearth and ignited by any suitable means, after which door 21 is closed. Draft inlets 26 and 27 are then opened a desired amount to allow air to enter the fire chamber to maintain combustion of the log. The path of air and gases through the fire chamber is indicated in FIG. 2 by solid arrows. As the log is consumed by the flames, hot gases and smoke rise from the fire; the initial direction of flow of such hot gases and smoke is upward and toward the rear of the fire chamber where flue 31 is located. As they rise and flow toward the rear, the hot gases contact air pipes 17, 18, 19 and 20 and the front wall 32*a* of the air chamber, thus heating the metal from which such pipes and chamber are fabricated. Because of the barrier created by air chamber 32, the hot gases and smoke must rise over it in their path toward the flue; without baffle plate 33, the path of travel of the hot gases would then be in a substantially horizontal direction toward flue 31, in which case very little if any contact would be made with the rear wall 32*b* of the air chamber. However, baffle plate 33 creates a barrier to the normal flow path of hot gases, forcing them downwardly along the rear wall 32*b* of the air chamber before they pass under the bottom edge of the baffle plate and then out the flue; in this way the rear wall of the air chamber is also heated through contact with the hot gases from the burning log 34.

Blower 25 forces ambient room air, illustrated by broken arrows, up through the air chamber 32, through air pipes 17, 18, 19 and 20 and back into the room at the front of the stove. The ambient air picks up heat from the heated walls of the air chamber and air pipes and thereby the room in which the stove is located is provided with a constant flow of heated air.

Although use of a blower is not absolutely necessary with my stove, since heated air would flow by convection through the air chamber and air pipes, I prefer using a blower to increase the air flow because more heat is thereby extracted from the walls of the air chamber and air pipes and consequently from the hot gases rising from the fire. I may additionally provide a rheostat in the blower circuitry so that the amount of heated air flowing into the room can be regulated as desired.

In order to maximize the amount of heat picked up by the ambient air flowing through my stove, it is preferable that the air flowing into air chamber 32 contact as much of the interior wall surface of the air chamber as possible and that the air flow into the air pipes be uniformly divided between the pipes. To accomplish these purposes, I provide interior deflecting means within the air chamber 32. Such means are in the form of vanes 35, 36, 37, 38 and 39 in the embodiment illustrated in FIGS. 3 and 4. Each vane is formed from a metal plate having a width equal to that of the interior of the air chamber. Vanes 36, 37 and 38 are all substantially equal in length; the top ends of the vanes are welded to the top plate 32*c* of the fire chamber at points approximately midway between the ends of air pipes 17 and 18, 18 and 19, and 19 and 20, respectively, and the vanes are positioned so that their bottom ends divide into four approximately equal sections the area of the hole 50 in bottom plate 10 through which air enters the air chamber. Vanes 36, 37 and 38 serve to split the column of air entering the chamber into four equal segments, and vanes 35 and 39 serve to further divide the two outer portions of the air flow so that air entering the air chamber is caused to flow to substantially all portions of the interior thereof and thereby pick up maximum heat from the air chamber walls.

In order to control the amount of air admitted to the fire chamber for combustion, I prefer to use draft inlet means comprising adjustable openings; with such draft inlet means, the air supplied to the fire chamber can be regulated so as to provide only the minimum air necessary to sustain combustion, and thus maximize the burn time for each log can be maximized. One adjustable draft inlet means which I have found suitable for this purpose is shown in an enlarged cross-sectional view in FIG.. 5. An opening 40 is cut into the door 21 of the stove. The opening is generally circular in shape, except that a piece of metal 41 bridges the opening across the diameter thereof, the bridging piece having a threaded hole at its center; around the circumference of the opening 40 there is a raised lip 42. A substantially hemispherical cup 43 is shaped with an inside diameter and a shoulder 44 of such dimensions that the cup will seat itself on lip 42 formed in door 21 and thereby form a substantially airtight seal when lip and cup are in abutting contact with one another. A threaded hole in the center of the cup wall receives a threaded rod 45 having a knurled knob 46 at one end. The other end of threaded rod 45 is received by the threaded hole in metal piece 41 bridging the opening 40 in the stove door, so that the position of the cup with respect to the door can be adjusted by turning knurled knob 46 in one direction or the other. When the fire in the fire chamber is just getting started, maximum draft is desirable; in such case knurled knob 46 is turned counterclockwise to move cup 43 away from opening 40 and thereby provide free flow of air into the fire chamber. Once the fire is established, however, it is generally desirable to reduce the draft to a point just sufficient to sustain combustion, and for this purpose, knurled knob 46 is turned clockwise to bring cup 43 into close engagement with lip 42, thereby greatly restricting the flow of air to the fire chamber. With this design of draft inlet means it is possible, provided the tolerances are close enough, to extinguish the fire in the fire chamber by bringing shoulder 44 into tightly abutting relationship with lip 42.

Figure 7:
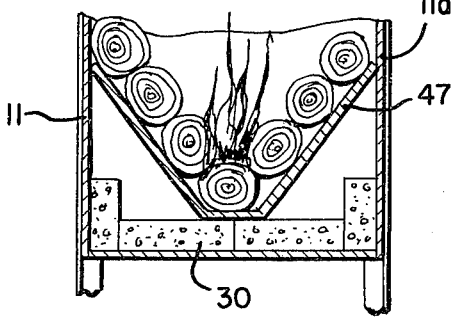
FIG. 7 is a fragmentary view illustrating an optional log feeding trough.

In some cases it may be desirable to load the fire chamber of my stove with a number of logs. For this purpose, I may provide a log-feeding trough as shown in FIG. 7. Referring to FIG. 7, the log feeding trough 47 is substantially "V"-shaped and is positioned in the fire chamber with its bottom resting on hearth. The sides of the trough slope upwardly away from each other to the sides of the fire chamber, and logs are stacked in the trough as illustrated in FIG. 7. With this log feeder, a number of logs, 7 in the illustration of FIG. 7, can be stacked within the fire chamber; when the log at the bottom of the feeder is completely burned, another log will slide to the bottom from one of the sides so that combustion will not be interrupted to any great degree.

Figure 6:
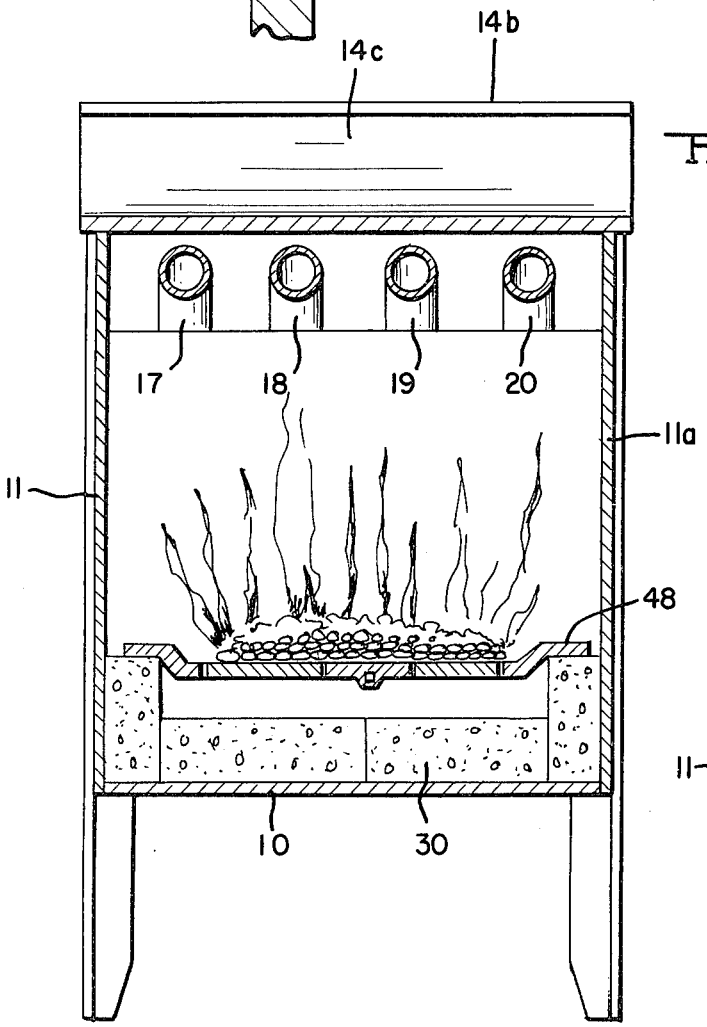

In the event it should be desired to burn coal or the like in place of wood in my stove, I may provide grate means as shown in FIG. 6. The grate means 48 are constructed so as to rest on the top of the fire bricks 30 which line the sides of the hearth area of the fire chamber, and are spaced above the hearth so that air entering the fire chamber through the draft inlet means can permeate the entire bed of coals for optimum combustion thereof.

I have found that with my stove I can heat a room for extended periods of time, as much as 24 hours, using a single log, and that with proper adjustment of the draft inlets complete combustion of the log can be achieved, i.e., very few ashes accumulate on the hearth. Also, because of the thorough contact of hot gases with the walls of the air pipes and air chamber, a very high proportion of the heat is extracted from such gases and transferred to the ambient air so that the gases escaping through the flue are at a relatively low temperature; thus, with my stove the danger of burns from a hot flue or flue pipe is less than with conventional stoves of the prior art.

While I have shown and described a present preferred embodiment of the invention, it is to be distinctly understood that the invention is not limited thereto, but may be otherwise variously embodied within the scope of the following claims:

I claim:

1. A wood burning stove for providing heated air to a room or similar area, comprising:

an enclosed fire chamber including a generally horizontal floor at the bottom thereof, a forward portion of the floor comprising a hearth for receiving wood to be burned;

draft inlet means at the front of the fire chamber;

a flue at the rear of the fire chamber and near the top thereof;

an enclosed air chamber positioned between the rear of the hearth and the rear wall of the fire chamber and extending generally vertically from the bottom of the fire chamber to a point spaced from the top of the fire chamber, the air chamber having front and rear walls, a bottom and a top, the bottom of the air chamber communicating with the ambient air;

at least one air pipe extending generally horizontally within and along the top portion of the fire chamber, one end of the air pipe communicating with the interior of the air chamber at the top of the air chamber and the other end opening to the ambient air at the front of the stove; and a generally vertical baffle plate positioned between and spaced from the air chamber and the rear wall of the fire chamber and extending the full width of the interior of the fire chamber, the baffle plate being joined at its top edge to the top of the fire chamber, the bottom edge of the baffle plate being spaced from the bottom of the fire chamber, whereby the flow of hot gases rising from a fire in the fire chamber will be such that the gases contact the surface of the air pipe and both the front and rear walls of the air chamber.

2. A wood burning stove as claimed in claim 1 in which the bottom of the air chamber communicates with the ambient air through a blower, whereby air can be blown through the air chamber and air pipe.

3. A wood burning stove as claimed in claim 2, in which a plurality of air pipes is provided, one end of each air pipe communicating with the air chamber and the other end of each opening to the ambient air at the front of the stove.

4. A wood burning stove as claimed in claim 3, in which the air chamber includes interior deflecting means so constructed and arranged as to cause air blown into the chamber by the blower to flow to substantially all portions of the interior of the air chamber and to enter each of the air pipes at substantially the same flow rate.

5. A wood burning stove as claimed in claim 4 in which the draft inlet means comprise adjustable openings in the front of the fire chamber, whereby the air supplied to the fire chamber can be regulated between zero and a predetermined maximum rate.

6. A wood burning stove as claimed in claim 5 in which a substantially "V"-shaped trough is positioned within the fire chamber, the bottom of the trough resting on the hearth and the sides of the trough sloping upwardly away from each other, whereby when several logs are stacked in the trough, complete combustion of the log at the bottom of the trough will allow another log to slide to the bottom from one of the sides, such that combustion will not be interrupted.

7. A wood burning stove as claimed in claim 5 in which grate means are mounted within the fire chamber and spaced above the hearth to permit burning of coal in place of wood when desired.

* * * * *